United States Patent [19]

Nilsson

[11] Patent Number: 4,633,936

[45] Date of Patent: Jan. 6, 1987

[54] HEAT EXCHANGER

[76] Inventor: Sven M. Nilsson, Småkullevägen 18, S-430 50 Kållered, Sweden

[21] Appl. No.: 638,466

[22] PCT Filed: Nov. 29, 1983

[86] PCT No.: PCT/SE83/00415

§ 371 Date: Jul. 27, 1984

§ 102(e) Date: Jul. 27, 1984

[87] PCT Pub. No.: WO84/02179

PCT Pub. Date: Jun. 7, 1984

[30] Foreign Application Priority Data

Nov. 30, 1982 [SE] Sweden ..... 8206809

[51] Int. Cl.[4] ..... F28D 19/00

[52] U.S. Cl. ..... 165/8; 165/10

[58] Field of Search ..... 165/10, 8

[56] References Cited

U.S. PATENT DOCUMENTS 3,290,764 12/1966 Dore et al. ..... 165/10

3,901,309 8/1975 Thebert ..... 165/10

4,307,774 12/1981 Draunieks ..... 165/10

FOREIGN PATENT DOCUMENTS 311889 5/1929 United Kingdom ..... 165/10

*Primary Examiner*—Albert W. Davis, Jr.

*Attorney, Agent, or Firm*—Harness, Dickey & Pierce

[57] ABSTRACT

A rotary regenerator consisting of two sheets or webs which are wound to form the rotor of the regenerator. One of the webs is corrugated in crosswise web direction, and the other is corrugated in the lengthwise web direction. The other sheet is under high tension, which results in the two sheets being pressed together with such a force that they are presented from sliding apart when the regenerator is working.

5 Claims, 6 Drawing Figures

HEAT EXCHANGER

Figure 1:
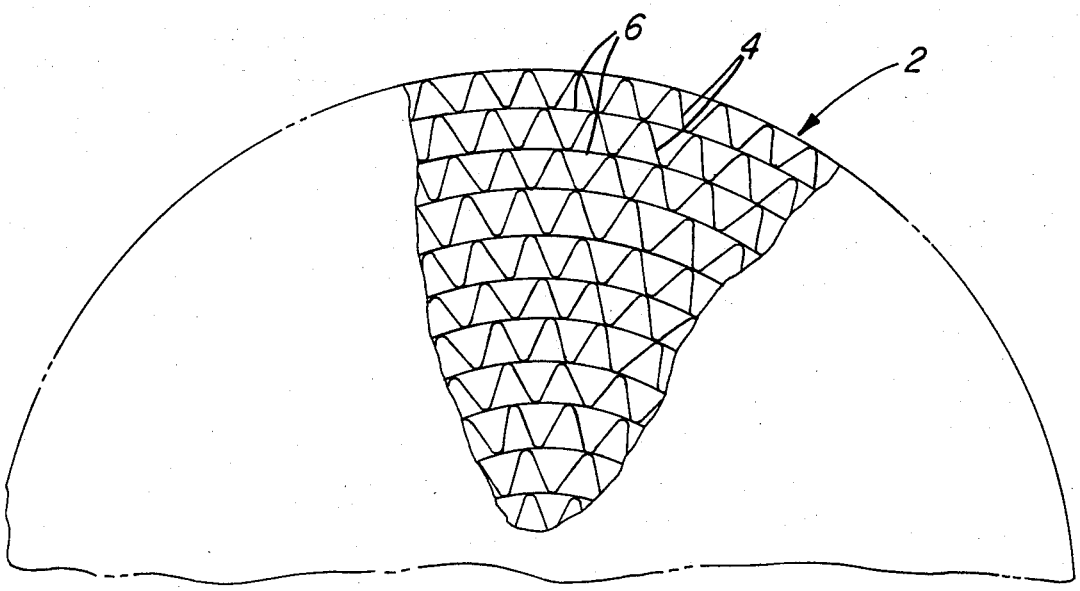

The subject invention relates to a heat exchanger, a method of producing it and a machine for performing the method.

Heat exchangers of the kind contemplated herein comprise two metal webs, preferably of aluminium, which webs are arranged in superposed relationship and wound about a core. One of the webs is provided with corrugations extending in the crosswise direction of the web so as to form channels which extend through the heat exchanger. In its operational condition, the heat exchanger forms a rotating wheel, wherein the exchange of the heat is obtained by rotating the wheel between flows of fluid of different temperatures so that said fluid flows are heated or cooled by the walls of said channels.

Heat exchangers of the type concerned herein are known since 1924. In the technical field to which the subject invention belongs, i.e. recovery of heat/cold with the aid of ventilation air, wheels of this kind began to be used to an increasing degree after the second World War. The energy crisis of 1975 has speeded up the use further.

In the beginning, the wheels were made of strips of asbestos. In the middle of the 1960s the use of webs of aluminium foil was initiated. The corrugated (pleated) and plane (straight) foils were joined together by means of epoxy or polyurethane glue. However, the problems of manufacturing this kind of wheels are considerable, in addition to which their strength and durability are inferior.

The problems arising in the manufacture of wheels of this kind are mainly concerned with the glue. It has to be applied very exactly on the crests of the pleats. In addition, the glue must not spread or be pulled out during the winding-on operation. After the winding-on operation the wheel must be transferred to an oven, wherein the glue is allowed to set. During this process the glue serves as a lubricant encouraging movement between the pleats and the plane foil, which makes the handling of the wheel delicate. During the setting process excess glue has a tendency to spread and block the channels to a larger or smaller extent. In addition, the glue may also be the cause of exzema, allergies and other similar serious illnesses which are difficult to remedy.

A small (often invisible) fault in the glue bond may easily cause the total collapse of the wheel. It is therefore necessary to test the wheels carefully for strength before they are installed.

However, this safety measure is not enough since the strength of the glue bond often deteriorates in some environments as the glue gradually decomposes. This has lead to a large number of wheel collapses, particularly of large (diameter sizes of 3 meters or more) and heavily loaded wheels. The costs of repair or exchange of such large-size wheels are exceptionally high.

The technical problems involved in obtaining long-term durability and strength of glue bonds in aluminium in moist environments and the difficulty in solving these problems are well known to the artisans in the field.

Various methods have been attempted to solve these problems.

The safest (but also the most expensive) way of solving the problem is to cut the wheel into segments, after the gluing operation, and to insert the segments in self-supporting frames. The method is very complicated and expensive. Another method uses 4 to 8 spokes which are inserted into channels milled into the two faces of the wheel to take the majority of the strain. This method is used predominantly in smaller wheels having a maximum diameter of about 1.5 to 2 meters.

A third method also uses 4 to 8 spokes which are hammered or drilled diametrically through the wheels after the wheel-glueing operation. This method is used generally by several manufacturers.

The spokes, however, reduce the through-flow area and complicate the manufacture. In addition, the long-term effect has not yet been tested.

The purpose of the subject invention is to solve the above problems found in heat exchange rolls in which glue bonds are used. This is achieved in accordance with the teachings of the invention in that the two webs are joined together through mutual frictional abutment while the second one of said webs is being highly tensioned in its lengthwise direction, whereby the two webs will be pressed hard together and in that the second web is secured by its outer end relative to the rest of the wheel. In this manner glue bonds become superfluous and the disadvantages described above in connection with prior-art technique are eliminated.

Figure 2:
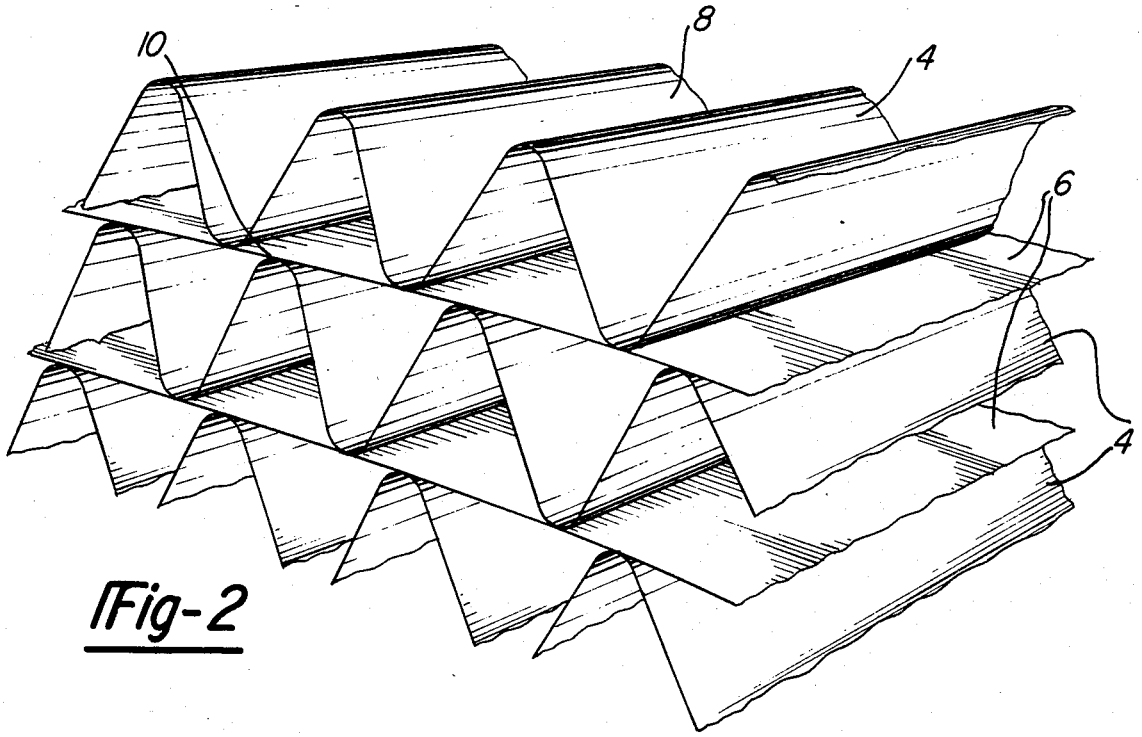
Figure 3:
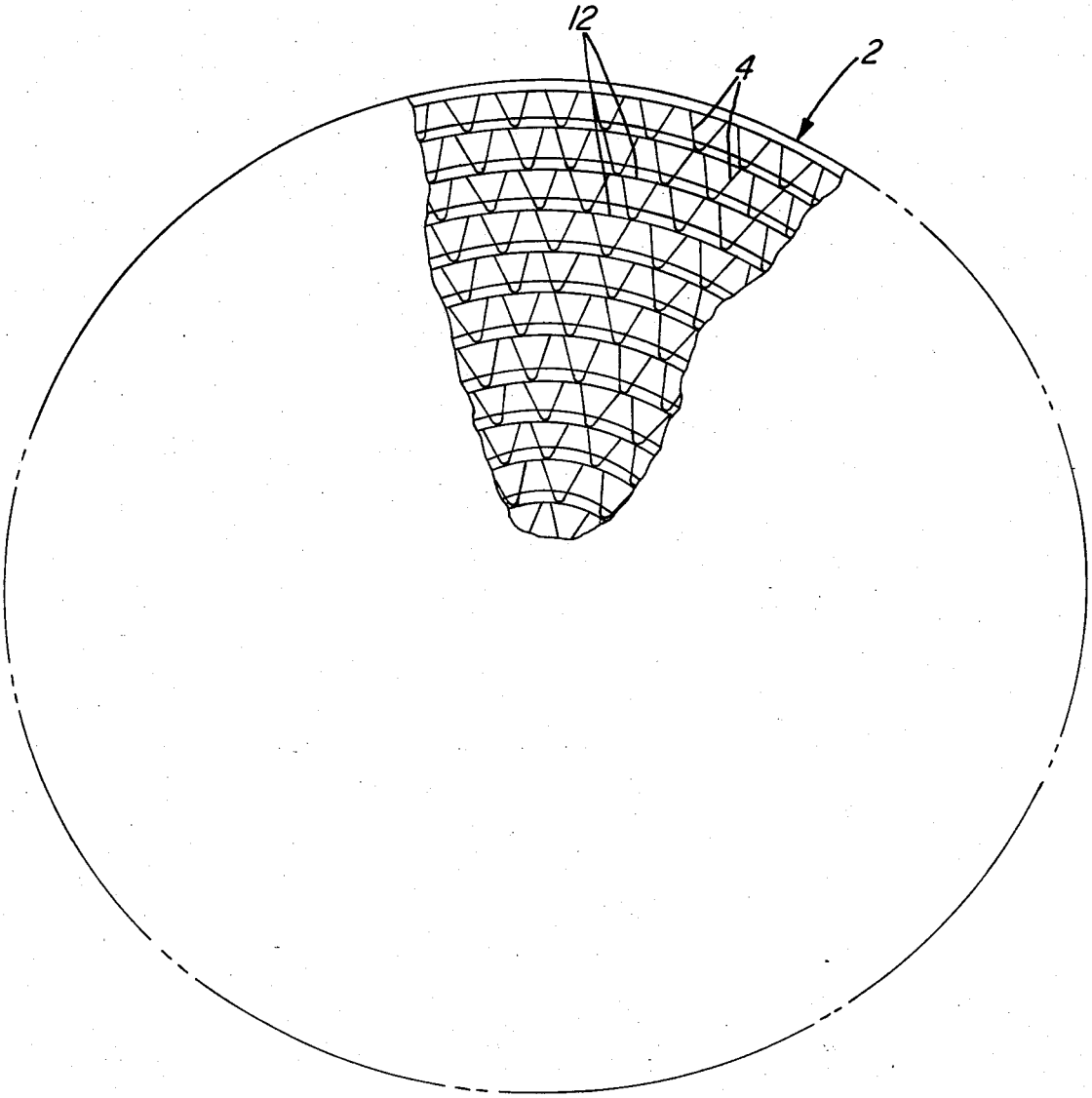
Figure 4:
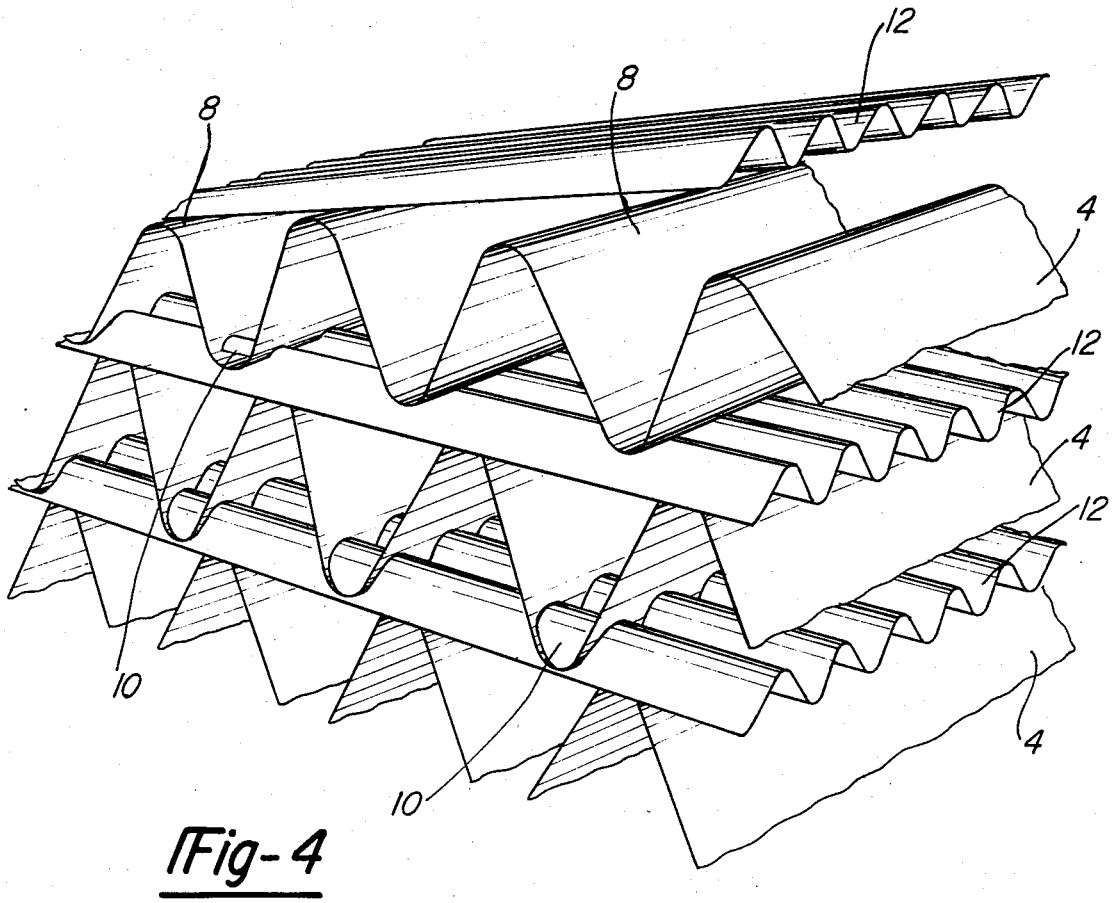
Figure 5:
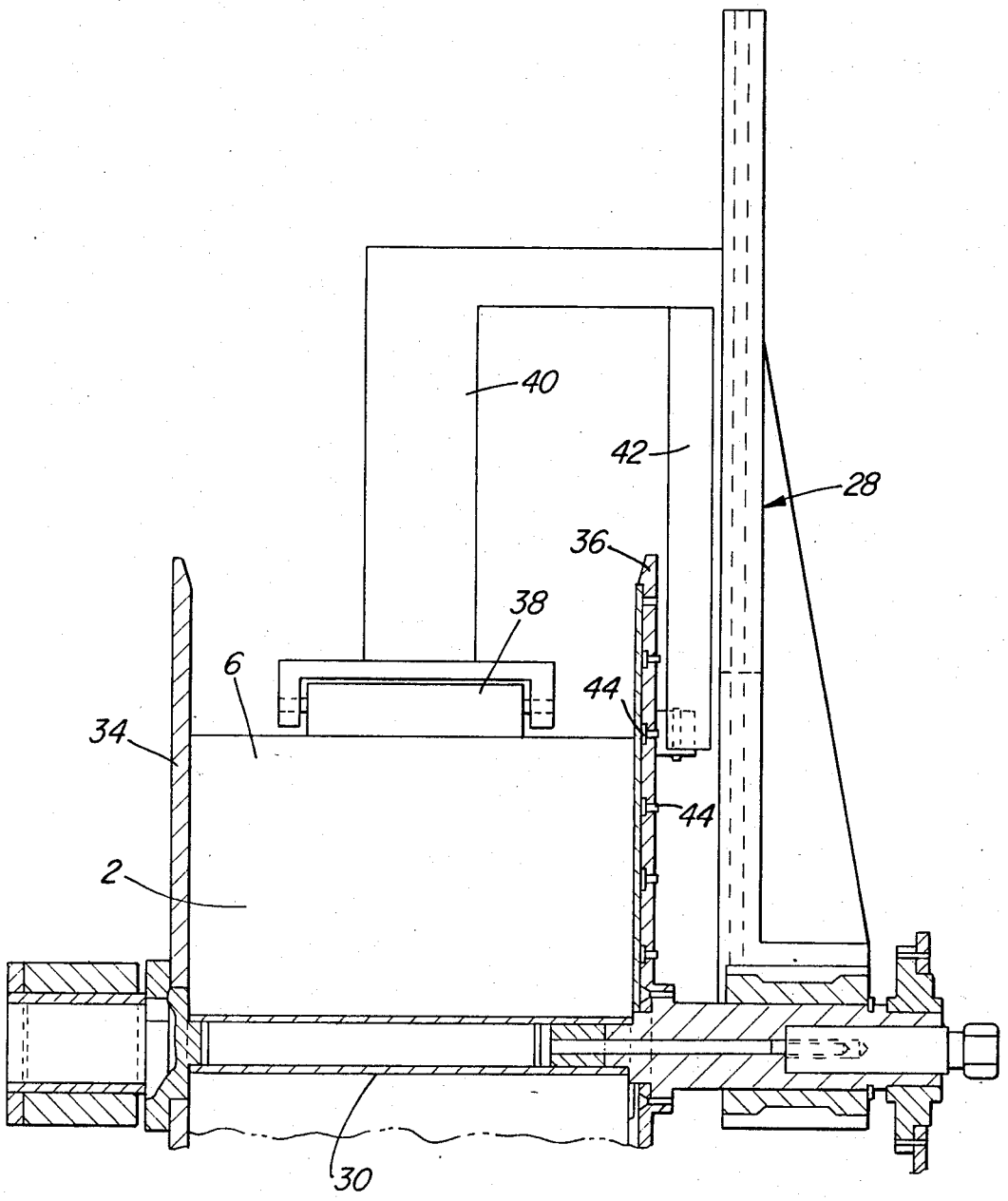
Figure 6:
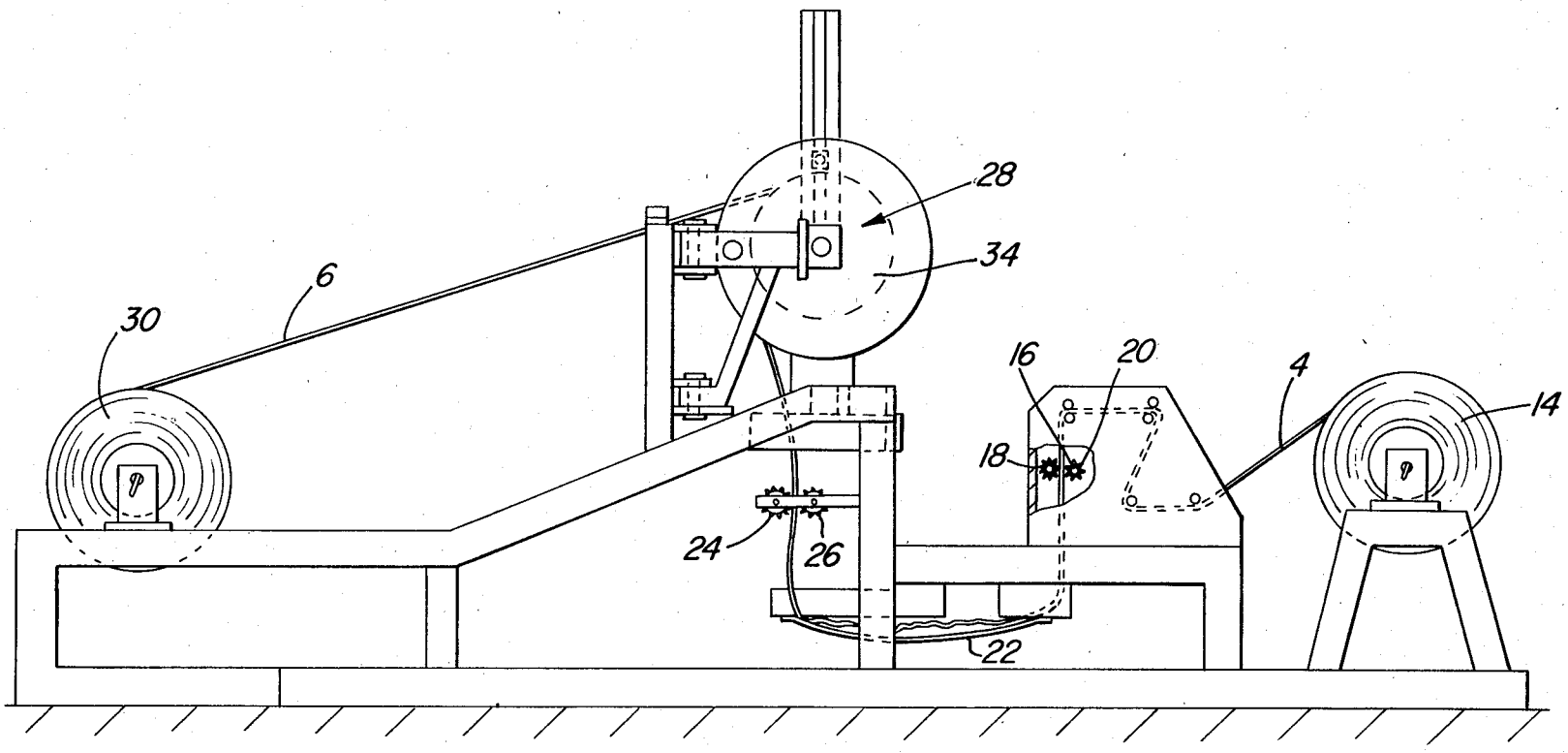

The invention will be described in the following in closer detail with reference to the accompanying drawings, wherein FIG. 1 is a general view of a heat exchanger in accordance with the subject invention as seen from the side, showing the principle of the heat-exchanger construction, FIG. 2 is a perspective view of a cut-out detail of this heat exchanger, FIGS. 3 and 4 are similar respectively lateral and perspective views of a heat exchanger in accordance with a second embodiment of the invention, FIG. 5 is a cross-sectional view through a machine in accordance with one embodiment designed to produce heat exchangers in accordance with the subject invention. This machine is known per se and is described in the Swedish Patent published under No. 424 277, FIG. 6 is a general view of a machine designed to produce heat exchangers in accordance with the invention, this machine corresponding to the one described in SE No. 8008011-2.

The heat exchanger in accordance with the invention, referred to as a unit by numeral reference 2, consists of two webs 4 and 6 of aluminium which are wound about each other in superposed relationship. The web 4 is formed with corrugations comprising ridges 8 and depressions 10. The other web 6 is plane (straight) in accordance with the embodiment shown in FIGS. 1 and 2. The corrugations form channels extending throughout the heat exchanger allowing through-flow of fluids (primarily ventilation air). FIGS. 3 and 4 show a heat exchanger in accordance with a second embodiment of the invention according to which the second web, in this case referred to by numeral 12, is given a wavy configuration with the waves extending in the lengthwise web direction.

The two webs are produced in a prior-art manner, see SE No. 8008011-2. FIG. 6 shows one example of production of the heat exchanger. The web 4 is wound off a rotating roll 14, is fed up to a corrugating station 16, wherein it passes through the nip of rollers 18, 20 which are provided with interengaging cogs, the latter extending in the axial direction of the rollers. The web 4 is then advanced across a plate 22 and further up between two guide or master rollers 24, 26 to the winding-on station 28. The second web 6 or 12 is supplied from a rotating roll 30 and advanced up to the winding-on station 28 wherein the two webs are wound about each other.

By restraining the movement of the roll 30 the web 6, 12 is tightened, whereby a tension is generated therein. This tension preferably has a magnitude of at least 100 kp for a foil of width of 250 mm ($\approx$6 kp mm$^2$) in order to impart the desired strength to the heat exchanger roll. The aluminium foil has a thickness of appr. 60 $\mu$m (the cross-sectional diameter thus will be 15 mm$^2$).

FIG. 5 shows one embodiment, cf SE No. 424 277, of a winding-on station 28. The latter comprises a core sleeve 32, onto which the two webs are wound. The winding-on operation takes place between two end walls 34, 36. One, 34, of the end walls is arranged to be folded outwards after the winding-on of the webs to remove the finished heat exchanger roll 2, while the opposite wall 36 rotates together with the core sleeve 32, which is driven in any suitable manner, such as by belt or cog-wheel drive. A roller 38 presses against the outermost web 6 and arms 40, 42 are provided to attach the roller to the rear face of the end wall 36. Upon movement of the roller 38 towards the periphery of the end wall 36, which corresponds to winding-on of the webs 4, 6, clamping means 44 are urged outwards from the end wall 36, forcing the roll 2 against the end wall 34, thus relieving the pressure on the winding turns already wound onto the roller. This method is described in detail in SE No. 424 277 and in Patent Application SE No. 8008011-2.

The high tension in the second web 6 or 12 and the friction between the corrugated web 4 and the second web 6 or 12 has the effect that the heat exchanger 2, when in its completed condition, does not collapse in operation as a result of the two webs 4 and 6 or 4 and 12 sliding apart when exposed to the axial pressures (i.e. axial in relation to the finished wheel) generated by the flows of air. The coefficient of friction between two layers of aluminium (the material commonly used for this type of exchangers) normally is about 0.3 but by surface-treating the webs such as by roughing, knurling, etching or by using other surface-treatment methods, the coefficient may be increased to about 0.8.

Because the second web 12 has a wavy configuration in its lengthwise direction in the manner appearing from FIG. 4, a comparatively secure bond (cf FIG. 4) is obtained between the two webs. The highly tensioned web 12 presses into the ridges 8 and the depressions 10 in the web 4, impressing dents therein matching the waves formed in the web 12. This further increases the bond between the webs.

In order not to lose the tension in the second web 6 or 12 it is necessary, after completion of the winding-on operation and when the heat exchanger 2 is finished off, to anchor the trailing end of the web 6, 12 safely to the heat exchanger. This could be effected e.g. by adhesion. A cover is applied around the finished heat exchanger, the cover being e.g. a metal web which is riveted together to the desired cover configuration.

The embodiments of the invention described above are but examples thereof and a number of different embodiments and modifications are possible within the scope of the appended claims. The machine for the manufacture of the heat exchanger could be designed differently from that shown. Also the tension in the web 6, 12 could be provided in another way from that shown. For instance it could be effected by clamping the web 6, 12 between brake shoes.

What is claimed is:

1. A heat exchanger comprising two metal webs arranged in superposed relationship and wound about a core, the first one of said webs being formed with corrugations extending in the crosswise web direction, said corrugations forming channels throughout the heat exchanger, the second of said webs having a wavy configuration with the waves extending in the lengthwise direction, said heat exchanger forming, in its operational condition, a rotating wheel wherein the exchange of heat is obtained by rotating the wheel between flows of fluid of different temperatures so that said fluid flows are heated or cooled by the walls of said channels, characterised in that the two webs are joined together through mutual frictional abutment, the second web being highly tensioned in its lengthwise direction, whereby the two webs will be pressed hard together, said waves of said second web being arranged, when the two webs are joined together, to press into the ridges and depressions of the corrugations formed in said first web and said second web being attached by its outer end relative to the rest of the wheel.

2. A heat exchanger in accordance with claim 1, characterised in that the surfaces of said webs are surface-treated to increase the friction.

3. A heat exchanger in accordance with claim 1, characterised in that the outer end of the second web is attached to the heat exchanger and in that a cover is applied about the heat exchanger.

4. A heat exchanger in accordance with claim 2, characterised in that the outer end of the second web is attached to the heat exchanger and in that a cover is applied about the heat exchanger.

5. A heat exchanger as claimed in claim 1 wherein the corrugations in the first web are disposed so that joined sides extend at an acute angle to each other.

* * * * *